United States Patent [19]

Golding

[11] Patent Number: 4,826,388

[45] Date of Patent: May 2, 1989

[54] MANHOLE COVER LIFTER

[76] Inventor: Simon S. Golding, 221 Autumn St., Geelong West, 3218 Victoria, Australia

[21] Appl. No.: 175,509

[22] Filed: Mar. 31, 1988

[30] Foreign Application Priority Data

Apr. 1, 1987 [AU] Australia ..... PI1195

[51] Int. Cl.[4] ..... B66F 11/00

[52] U.S. Cl. ..... 414/684.3; 254/131; 280/46; 280/47.24

[58] Field of Search ..... 414/684.3, 641; 212/166; 254/131; 280/46, 43.2, 47.24, 43.1

[56] References Cited

U.S. PATENT DOCUMENTS

| | | | |
|---|---|---|---|
| 2,655,399 | 10/1953 | McMillan | 254/131 X |
| 3,827,707 | 8/1974 | Bierman | 280/47.24 X |
| 4,365,925 | 12/1982 | Girtz | 414/684.3 |
| 4,488,706 | 12/1984 | Kono | 254/131 |
| 4,653,728 | 3/1987 | Mochizuki et al. | 254/131 |

FOREIGN PATENT DOCUMENTS

| | | |
|---|---|---|
| 487348 | 2/1976 | Australia . |
| 506577 | 2/1977 | Australia . |
| 815472 | 6/1959 | United Kingdom . |
| 1500632 | 2/1978 | United Kingdom . |
| 2045206A | 10/1980 | United Kingdom . |
| 2136363A | 9/1984 | United Kingdom . |
| 2170473A | 8/1986 | United Kingdom . |

*Primary Examiner*—Robert J. Spar
*Assistant Examiner*—Donald W. Underwood
*Attorney, Agent, or Firm*—Robert R. Jackson; Leon R. Yankwich

[57] ABSTRACT

The present invention provides a manhole cover lifter having a key to be located in the manhole keyhole and a lever arrangement to provide the mechanical advantage for lifting the manhole cover. The key may be directly attached to the lever, or indirectly attached thereto by a lifting bar.

11 Claims, 8 Drawing Sheets

MANHOLE COVER LIFTER

The present invention relates to a tool for lifting manhole covers.

Examples of the prior art tools are disclosed in Australian Pat. Nos. 487,348 and 506,577. In practice these tools have proven unsatisfactory as they are prone to fracture, rendering the tool useless. This disadvantage has arisen principally because the foot is a casting. A further disadvantage is the number of rollers in its construction and the high cost of manufacture.

Accordingly it is an object of the present invention to alleviate these disadvantages and reduce the cost of manufacture of such a tool.

With this object in view the present invention may provide a tool for lifting manhole covers, said tool including a base member, at least one key adapted to engage a corresponding keyhole in a manhole cover, said key being pivotally mounted at or adjacent one end of said base member directly or indirectly through a lifting bar, a roller or set of spaced apart wheels mounted on said base member inwardly of the other end thereof for rotation about an axis transverse to the longitudinal axis of said base member, a handle or lever coupled at one end to said base member adjacent said one end, whereby engagement of said at least one key in said corresponding keyhole and application of a downwardly directed force on the other end of said handle or lever will cause pivotting of said base member about said transverse axis to lift said manhole cover from the ground and cause said manhole cover or lifting bar to engage a face of said base member.

Preferably said base member is a channel-shaped member with said key pivotally located between opposing faces of said channel-shaped member.

In a preferred embodiment of the invention said key includes a main body which is pivotally mounted to said base member and a key blade engaging with said main body. Preferably said key blade has a slide located thereon which also engages said manhole cover to prevent rotation of a withdrawn manhole cover.

In a further aspect of the invention there is provided a tool for lifting manhole covers said tool including a longitudinal lifting bar for straddling said manhole cover with a wheel at each end thereof, at least one key slidably located along said longitudinal lifting bar adapted to clampingly engage said lifting bar with said manhole cover, height adjustment means at either end of said longitudinal lifting bar for varying the height of said longitudinal lifting bar from the ground to allow said manhole cover to be removed and a handle coupled to said lifting bar.

In yet another aspect of the invention there is provided a tool for lifting manhole covers, said tool including a longitudinal support for straddling said manhole cover with a wheel at each end thereof, height adjustment means at either end of said longitudinal support for varying the height of said longitudinal support from the ground, at least one lifting bar attached to said longitudinal support, each lifting bar having at least one key slidably located along said lifting bar adapted to clampingly engage said lifting bar with said manhole cover and a handle coupled to said longitudinal support.

In order that the invention may be better understood and put into practical effect there will now be described with reference to the accompanying drawings preferred non-limitative practical embodiments of a tool for lifting manhole covers made according to the present invention. In the drawings.

Figure 1:
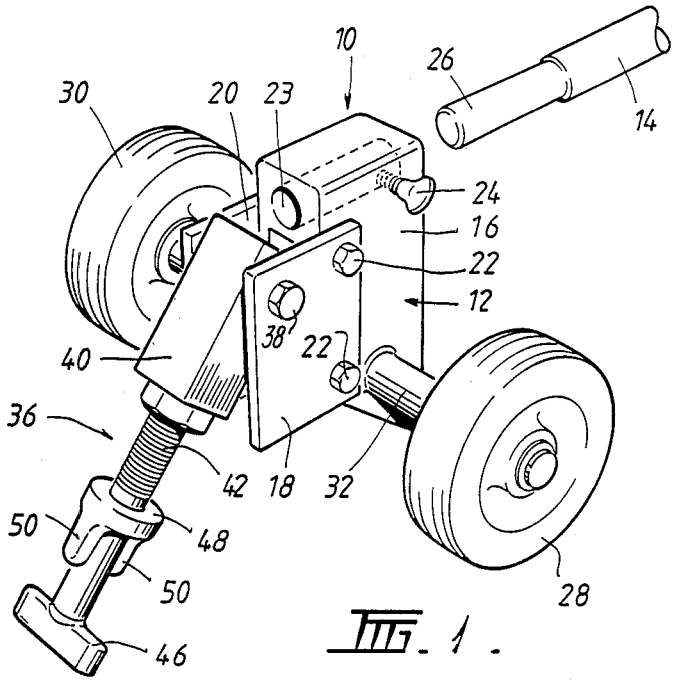
FIG. 1 is a perspective view of a first embodiment of a tool for lifting lightweight manhole covers.
Figure 2:
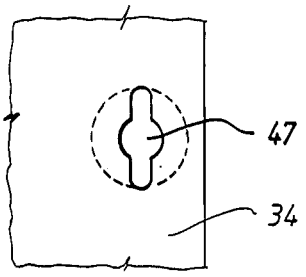
FIG. 2 is a plan view of a keyhole of a manhole cover which can be lifted by the tool shown in FIG. 1.
Figure 3:
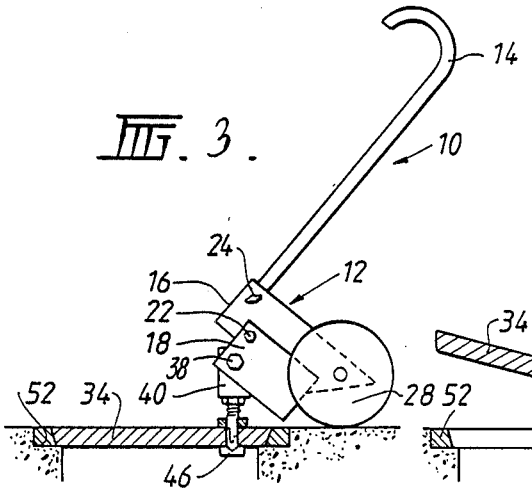
FIG. 3 is a side view of the tool shown in FIG. 1 coupled to a manhole cover in the initial lifting position.

Referring to FIGS. 1 to 4 there is shown a tool 10 which comprises a base member 12 and handle 14. Base member 12 is basically formed of three parts, namely a channel-shaped member 16 and two sideplates 18, 20 secured to the sidewalls of channel-shaped member 16 by fasteners 22. It is clear that this arrangement can be altered to suit requirements as base member 12 could readily be a one part member. Handle 14 passes through an aperture 23 in channel-shaped member 16 and is clamped into position by locking fastener 24. In this manner handle 14 may be readily removed for compact storage of the tool. To assist in coupling handle 14 to member 16 a reduced diameter portion 26 is provided. As will be obvious, it is not necessary to have handle 14 removable, as it could be welded to member 16 if required.

For pivotting of tool 10 a pair of spaced apart wheels 28, 30 are rotatable on axle 32 which passes through, and is welded to, sideplates 18, 20. The wheel diameter is selected to provide the desired height from the ground for base member 12.

To remove a manhole cover 34 a key 36 is pivotally secured on a fastener 38 passing through sideplates 18, 20. Key 36 comprises a main body 40 which threadably receives manhole key or blade 42. The length of manhole key or blade 42 can accordingly be adjusted and secured by lock nut 44 which clampingly engages main body 40. Manhole key or blade 42 forms a T-shape with crossbar 46 and is shaped to be inserted into the manhole keyhole 47. To prevent manhole cover 34 from twisting off the manhole key or blade 42 a slide 48 is rotatably mounted thereon. Slide 48 includes depending fingers 50 which match the manhole keyhole 47. Key or blade 42 and slide 48 may be any shape and will be adapted to conform to the keyhole size and shape. A set of such keys and slides can be made to fit varying types of manhole covers.

Figure 4:
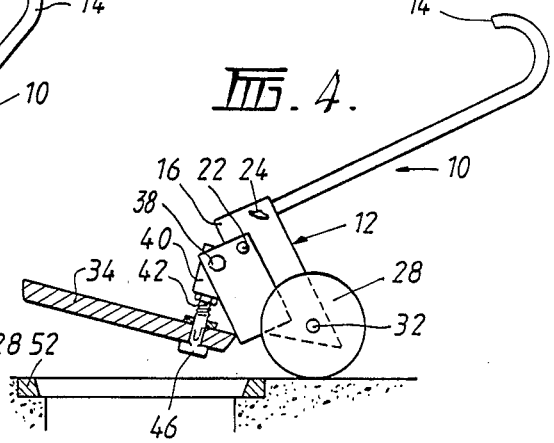
FIG. 4 is a similar view to that of FIG. 3 showing the manhole cover removed.

In use, tool 10 is wheeled up to manhole cover 34 and key or blade 42 is inserted into the manhole keyhole 47. The tool is then rotated to the position shown in FIG. 3 and slide 48 is then also inserted into the manhole keyhole 47 to lockingly engage the manhole cover 34. By pushing downwardly on handle 14 base member 12 will rotate about axle 32 and lift manhole cover 34 from its frame 52. Further downward movement will cause manhole cover 34 to abut the ends of sideplates 18, 20 as shown in FIG. 4. In this position the manhole cover can be wheeled away to allow access to the manhole.

The embodiment shown in FIGS. 1 to 4 is very suitable for manhole covers used for telecommunications purposes. These covers are usually concrete covers in concrete frames. For the heavier manhole covers the tool shown in FIGS. 5 to 8 is recommended.

In describing the embodiment shown in FIGS. 5 to 8 similar reference numerals to those used in FIGS. 1 to 4 are used where applicable. In this embodiment handle 14 is telescopic and can be adjusted in length to provide greater leverage. Instead of using a simple "cane-type" handle, handgrips 60 are provided on a cross-bar 62. Instead of main body 40 being coupled to manhole key 42 it forms part of a lifting bar 64. Lifting bar 64 comprises two parallel members 66 separated by spacers 68. Main body 40 is pivotally attached to sideplates 18, 20 by axle 70 and cotter pins 72.

Manhole keys 42 are threadably engaged with a nut 74 supported on a plate 76 which lies across lifting bar 64. For providing a more compact unit for storage, extension 78 replaces one of the spacers 68. Extension 78 is apertured in order that it may be pivotally secured to sideplates 18, 20 by axle 70.

Figure 5:
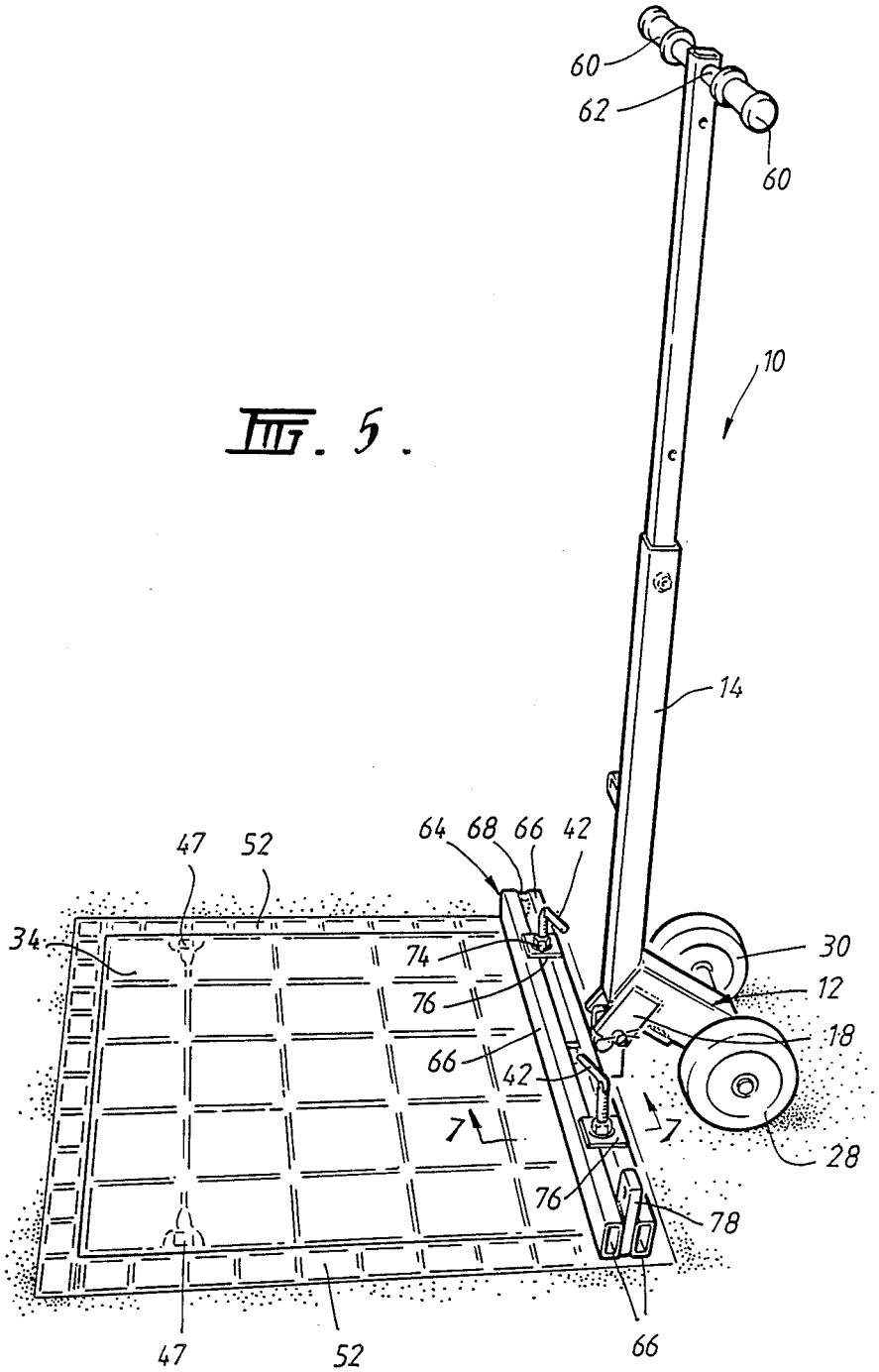
FIG. 5 is a perspective view of a second embodiment of a tool for lifting manhole covers in the initial lifting position.
Figure 6:
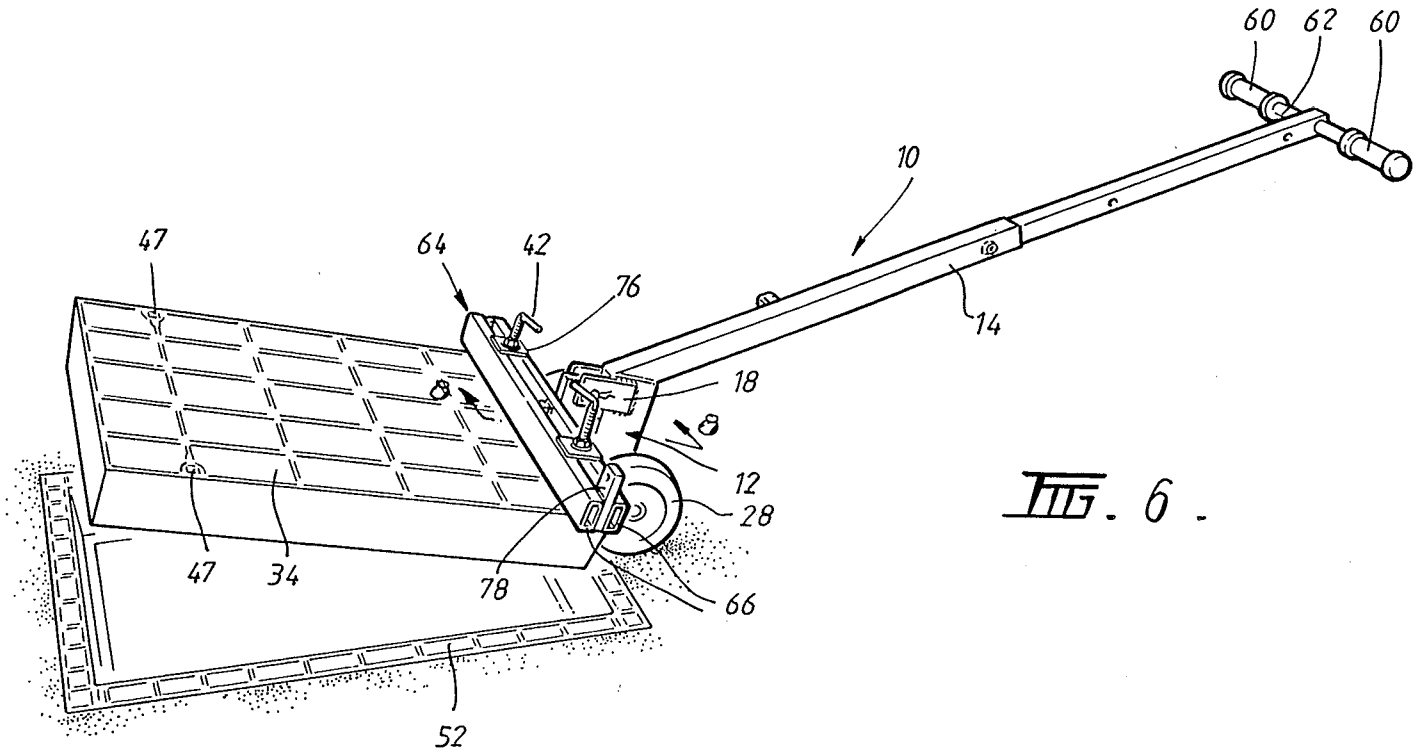
FIG. 6 is a similar view to that shown in FIG. 5 showing the manhole cover removed.
Figure 7:
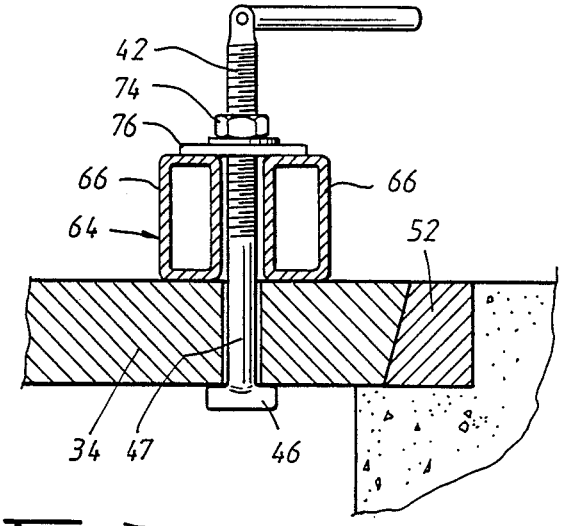
FIG. 7 is a cross-sectional view along and in the direction of arrows 7—7 of FIG. 5 showing attachment of the tool to the manhole cover.
Figure 8:
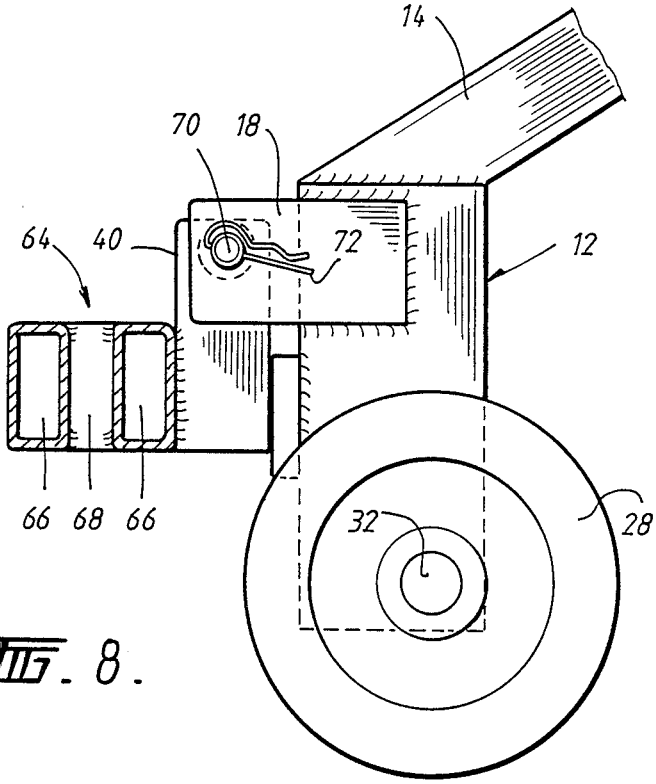
FIG. 8 is a cross-sectional view along and in the direction of arrows 8—8 of FIG. 6 showing how lifting occurs.

In use, the manhole cover lifter is positioned over the manhole cover 34 as shown in FIG. 5. Manhole keys 42 are located in keyholes 47 by sliding plates 76 along lifting bar 64 and turned to allow cross-bar 46 to be positioned as shown in FIG. 7. Nuts 74 are then tightened to lock lifting bar 64 to manhole cover 34. Once secured an operator levers the manhole cover out of frame 52 using handgrips 60 as shown in FIG. 6. The manhole cover can then be wheeled away to allow access to the manhole.

Figure 9:
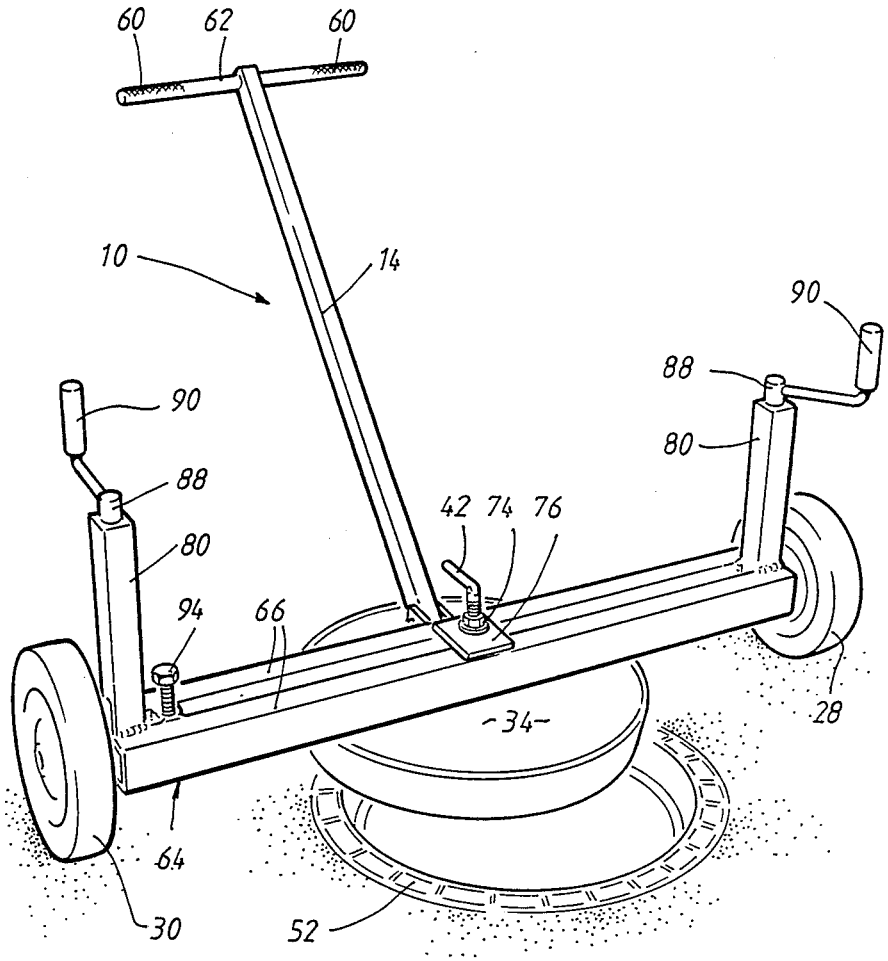
FIG. 9 is a perspective view of a third embodiment position.
Figure 10:
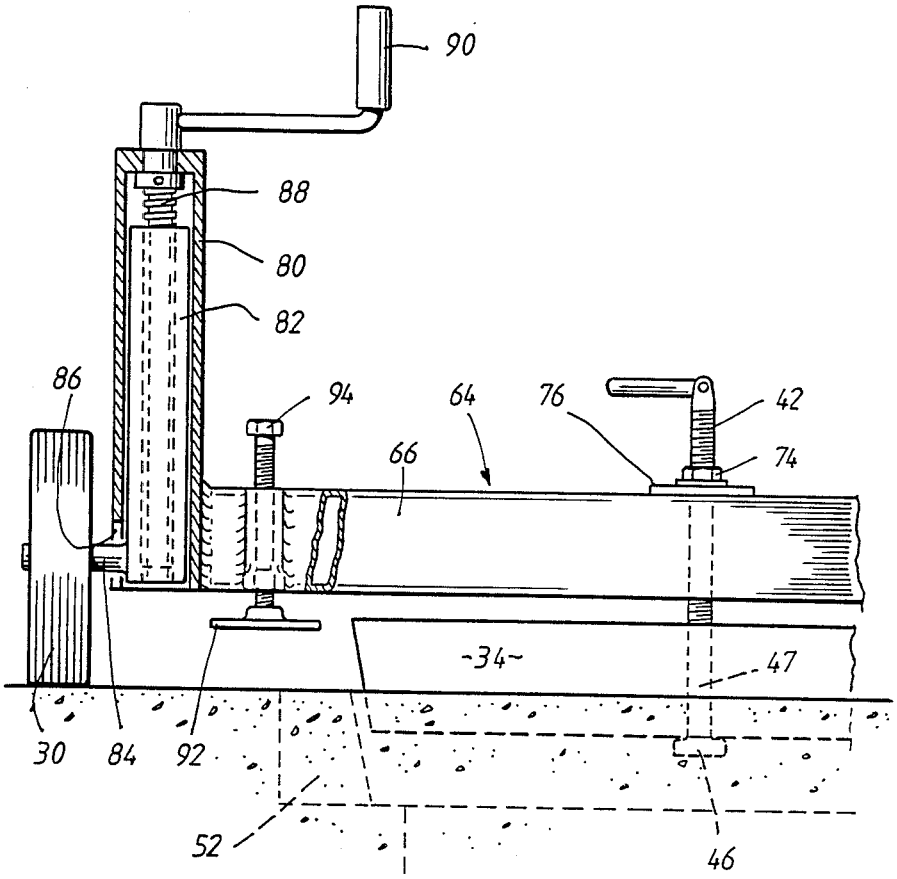
FIG. 10 is a partial cross-sectional view of the tool shown in FIG. 9.

The embodiment shown in FIGS. 9 and 10 uses a lifting bar 64 similar to that shown in FIGS. 5 to 8 but has no pivotting action with handle 14. Handle 14 is detachably connected to lifting bar 64 for ease of stowage. Spacers 68 are replaced by longitudinal housings 80 having threaded sleeves 82 contained therein. Each sleeve 82 has an axle 84 welded thereto which projects through aperture 86. A threaded crank 88 with handle 90 mates with threaded sleeve 82 to allow the height from the ground of lifting bar 64 to be varied. To assist in breaking the seal of the manhole cover 34 from frame 52 a screwthreaded plate 92 is used. Plate 92 has a threaded section 94 which is threadably engaged with lifting bar 64.

The operation of the manhole cover lifter shown in FIGS. 9 and 10 requires manhole key 42 to engage the manhole cover 34 as per the previous embodiments. Handles 90 are turned to raise the height of the lifting bar 64 from the ground and lift the manhole cover 34 from frame 52. If the manhole cover resists removal plate 92 can be screwed to allow the plate to engage the ground and act as a lever to break the seal between the manhole cover and frame.

Figure 11:
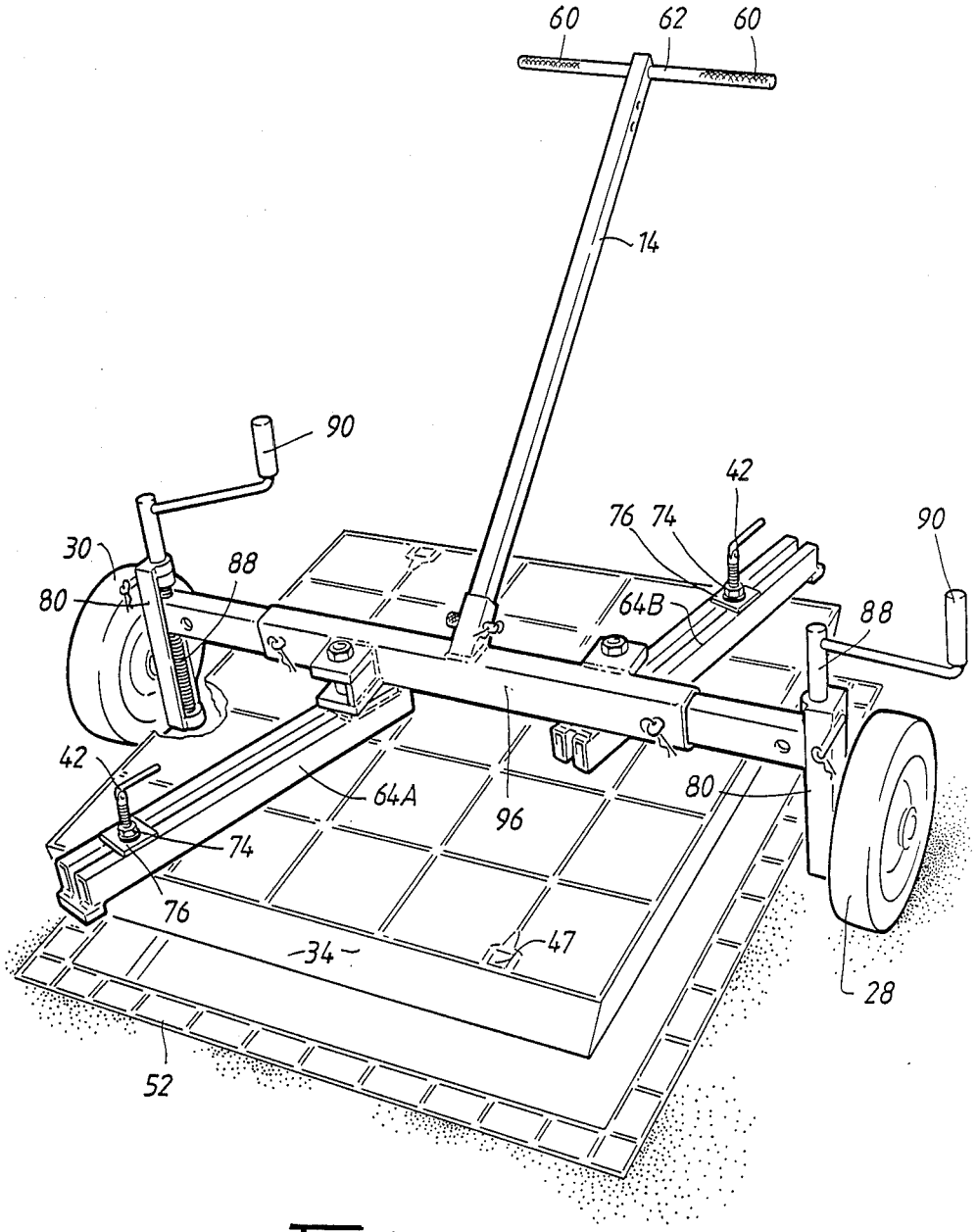
FIG. 11 is a perspective view of a fourth embodiment of a tool for lifting manhole covers shown in the lifted position.

In the embodiment shown in FIG. 11 handle 14 is secured to a main longitudinal support 96 which is adjustable in length through a telescopic action. Housings 80 and wheels 28, 30 are coupled to this support rather than the lifting bar 64 of the previous embodiment. Lifting bar 64 is split into two bars 64A, 64B which are pivotally connected to main longitudinal support 96.

Instead of using plate 92 (FIGS. 9 and 10) for breaking the seal between the manhole cover 34 and frame 52 housings 80 engage the ground to provide the required leverage action. By turning one of handles 90 the seal can be broken. Accordingly, wheels 28, 30 are directly attached to housings 80 as there is no threaded sleeve 82 (FIG. 10). Threaded cranks 88 threadably engage main longitudinal support 96 in lieu of threaded sleeve 82 (FIG. 10).

The operation of the embodiment shown in FIG. 11 is basically the same as the embodiment shown in FIGS. 9 and 10. By using contact of housings 80 with the ground to provide leverage to break the seal (if required) a simpler operation is provided.

Figure 12:
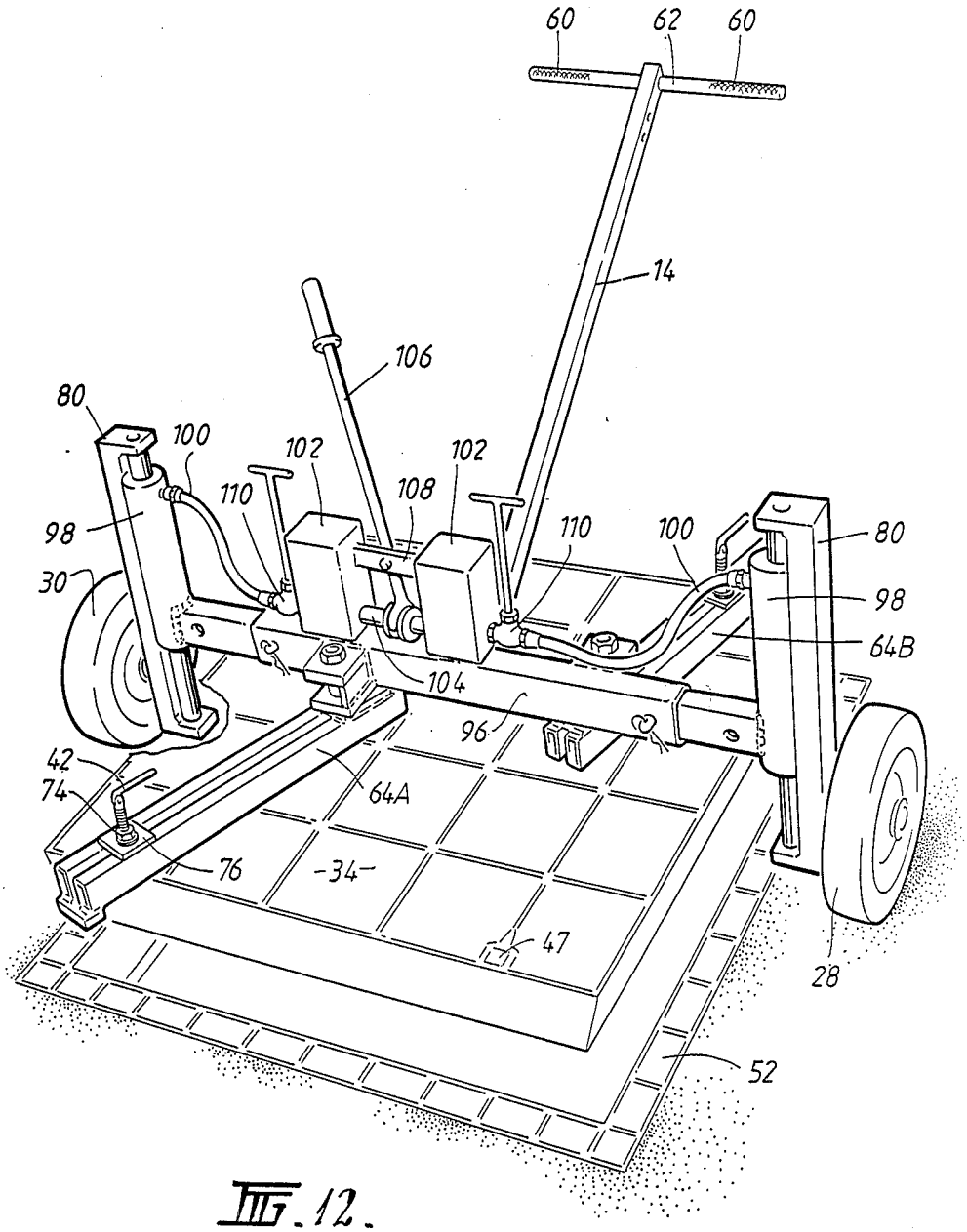
FIG. 12 is a perspective view of a modification to the tool shown in FIG. 11 using hydraulic operation.

The embodiment shown in FIG. 12 works in exactly the same manner as the embodiment in FIG. 11. The threaded cranks 88 are replaced by hydraulic piston and cylinder units 98. Each unit is supplied with hydraulic fluid through lines 100 from hydraulic accumulators 102. The accumulators are pressurized with a push-pull actuator 104 moved by handle 106 pivotted to support 108. By moving handle 106 backwards and forwards accumulators 102 can be pressurized allowing units 98 to extend to lift the manhole cover 34. Directional valves 110 control selection of the pressurized hydraulic oil to units 98 or to the exhaust of the accumulators 102.

All embodiments provide compact units which can be readily folded or disassembled when required. The various embodiments cover the full range of manhole covers presently used and substantially reduce the incidence of back injury to workers.

It is believed that the invention and many of its attendant advantages will be understood from the foregoing description and it will be apparent that various changes may be made in the form, construction and arrangement of the parts and that changes may be made in the form, construction and arrangement of the tools or lifters described without departing from the spirit and scope of the invention or sacrificing all of its material advantages, the forms hereinbefore described being merely preferred embodiments thereof.

I claim:

1. A tool for lifting manhole covers, said tool including a longitudinal support for straddling said manhole cover with a wheel at each end thereof, height adjustment means at either end of said longitudinal support for varying the height of said longitudinal support from the ground, two lifting bars pivotally attached to said longitudinal support, each lifting bar having at least one key slidably located along its respective lifting bar adapted to clampingly engage said lifting bar with said manhole cover and a handle coupled to said longitudinal support.

2. The tool as claimed in claim 1, wherein said handle is adjustable in length.

3. The tool as claimed in claim 1, wherein said longitudinal support is adjustable in length.

4. The tool as claimed in claim 1, wherein said height adjustment means comprises a screwthreaded adjustment means.

5. The tool as claimed in claim 1, wherein said height adjustment means comprises an hydraulic piston and cylinder means.

6. The tool as claimed in claim 1, wherein said height adjustment means abuts the ground to provide a lever action with said longitudinal support to break the seal of said manhole cover from a manhole cover frame.

7. A tool for lifting manhole covers, said tool including:

a base member having a top, bottom, front and rear faces, a pair of spaced apart sideplates protruding forwardly of said front face and secured to said base member, a pair of spaced apart wheels mounted on said base member adjacent said bottom and rear faces for rotation about an axis transverse to the longitudinal axis of said base member, a handle or lever coupled at the top of said base member, a key comprising a main body which is pivotally mounted between said spaced apart sideplates, a key blade for engaging a corresponding keyhole in a manhole cover, said key blade engaging with said main body and a slide located on said key blade which also engages said manhole cover to prevent rotation of a withdrawn manhole cover, whereby engagement of said key blade and slide in said corresponding keyhole and application of a downwardly directed force on the other end of said handle or lever will cause pivotting of said base member about said transverse axis to lift said manhole cover from the ground and cause said manhole cover to engage said forwardly protruding sideplates to allow for a balanced withdrawal of said manhole cover.

8. A tool for lifting manhole covers, said tool including:

a base member having a top, bottom, front and rear faces, a pair of spaced apart sideplates protruding forwardly of said front face and secured to said base member, a pair of spaced apart wheels mounted on said base member adjacent said bottom and rear faces for rotation about an axis transverse to the longitudinal axis of said base member, a handle or lever coupled at the top of said base member, a longitudinal lifting bar extending at least the width of said manhole cover, said lifting bar comprising a pair of spaced apart members and being rearwardly secured intermediate its length by a main body pivotally mounted between said spaced apart sideplates, a plurality of keys located on said longitudinal lifting bar and protruding through the space between said spaced apart members to provide clamping engagement of said lifting bar with said manhole cover through corresponding keyholes in said manhole cover, whereby engagement of said plurality of keys in corresponding keyholes and application of a downwardly directed force on the other end of said handle or lever will cause pivotting of said base member about said transverse axis to lift said manhole cover from the ground and cause said main body to engage said front face to allow for a balanced withdrawal of said manhole cover.

9. The tool as claimed in claim 8, wherein said keys are slidably located on said lifting bar.

10. The tool as claimed in claim 8, wherein said handle is adjustable in length.

11. The tool as claimed in claim 9, wherein said handle is adjustable in length.

* * * * *